United States Patent [19]
Wojcik
[11] 4,229,152
[45] Oct. 21, 1980

[54] EPICYCLIC GEAR SYSTEM AND DRIVING MEANS THEREFOR

[76] Inventor: Charles K. Wojcik, Box #42, University of Petroleum & Minerals, Dhahran, Saudi Arabia

[21] Appl. No.: 873,179

[22] Filed: Jan. 30, 1978

[51] Int. Cl.³ ..... F01C 1/08; F16H 3/44
[52] U.S. Cl. ..... 418/61 R; 74/750 R; 74/804
[58] Field of Search ..... 74/804, 805, 750 R, 74/784, 781 R; 418/61 R, 58

[56] References Cited

U.S. PATENT DOCUMENTS

| | | | |
|---|---|---|---|
| 1,401,659 | 12/1921 | Ward | 74/750 R |
| 2,066,952 | 1/1937 | Törnebohm | 74/750 R |
| 2,638,014 | 5/1953 | Railton | 74/750 R |

FOREIGN PATENT DOCUMENTS

| | | | |
|---|---|---|---|
| 2446036 | 3/1975 | Fed. Rep. of Germany | 74/804 |
| 1158638 | 7/1969 | United Kingdom | 418/61 R |

*Primary Examiner*—Allan D. Herrmann
*Attorney, Agent, or Firm*—Herzig & Walsh, Inc.

[57] ABSTRACT

An epicyclic gear system and driving means therefor comprise three planetary gears disposed within a sealed compartment to form two separate volumes; the planetary gears comprise a primary planetary gear and peripheral planetary gears and mesh with one another and with a stationary ring gear in said compartment. A rotor, eccentrically mounted with respect to the ring gear, is attached to the primary planetary gear. A fourth planetary gear is attached also to the rotor and is driven thereby in engagement with a stationary sungear. The fourth planetary gear is fixed to the primary planetary gear which is attached to the rotor and engages in planetary circular and rotary motion under the drive of the rotor and thereby furnishes a positive rotational impetus to the peripheral planetary gears. Ingress and egress ports communicating with the separate volumes defined by the compartment and the first planetary gears may be used for fluid inlets and outlets in conjunction with use of the system as a pump, a motor, an engine, or as a drive for a pump or other machine.

6 Claims, 4 Drawing Figures

EPICYCLIC GEAR SYSTEM AND DRIVING MEANS THEREFOR

BACKGROUND OF THE INVENTION

1. Field of the Invention

The invention pertains to epicyclic gear systems and driving means therefor, capable of use as motors, pumps, or engines or drive means for pumps or other machines.

2. Description of the Prior Art

Epicyclic gear systems comprising at least three planetary gears, with a primary planetary gear mounted on an eccentric fixed on a drive shaft and meshed with other two peripheral planetary gears which in turn are in mesh with a peripherally located stationary ring gear are known to the art.

In recent years, the use of an epicyclic gear system for fluid pumps or motors has been contemplated. In British Pat. No. 1,158,638 (dated July 16, 1969) to John Arthur Halliwell and David Eric Turnbull, such a system was described and claimed. In that system, three planetary gears are disposed within a sealed compartment to form two separate volumes for processing of fluid flow into and out of the system. A primary planetary gear is mounted on an eccentric fixed on a drive shaft at a selected distance away from the center of a surrounding stationary ring gear, which meshes with the peripheral planetary gears, the latter also meshing with the primary planetary gear. The system is driven through rotation of the rotor, which displaces the central planetary gear causing it to rotate against the peripheral planetary gears which in turn rotate against the peripheral ring gear. Operation of the existing system has proven unsatisfactory due to the fact that in the "dead center position", i.e. a position in which the three planetary gears are disposed in a straight line, the motion is undetermined and the system tends to jam. This constitutes a serious drawback to the feasibility and usefulness of the device. Various expedients which have been attempted to obviate the problem of jamming have hitherto proven unsatisfactory.

Therefore, there has been a felt but unfulfilled need for an epicyclic gear system capable of use as a pump, a motor, or an engine or drive for pumps or other machines which functions smoothly and consistently, without jamming at any point of its operation and, in particular, at its dead center position.

SUMMARY OF THE INVENTION

An epicyclic gear system capable of use as a pump, a motor, or an engine comprises a housing, a ring gear within the housing, a plurality of epicyclic gears comprising a primary planetary gear and peripheral gears disposed within the housing and sealed therein to form a first variable volume compartment and a second variable volume compartment within the housing, drive means attached to the primary planetary gear, the drive means including means for displacing said primary planetary gear and for imparting rotary motion to said primary gear about the axis thereof, the two peripheral planetary epicyclic gears being in engagement with the ring gear and with the primary planetary gear.

DETAILED DESCRIPTION OF THE INVENTION

Figure 1:
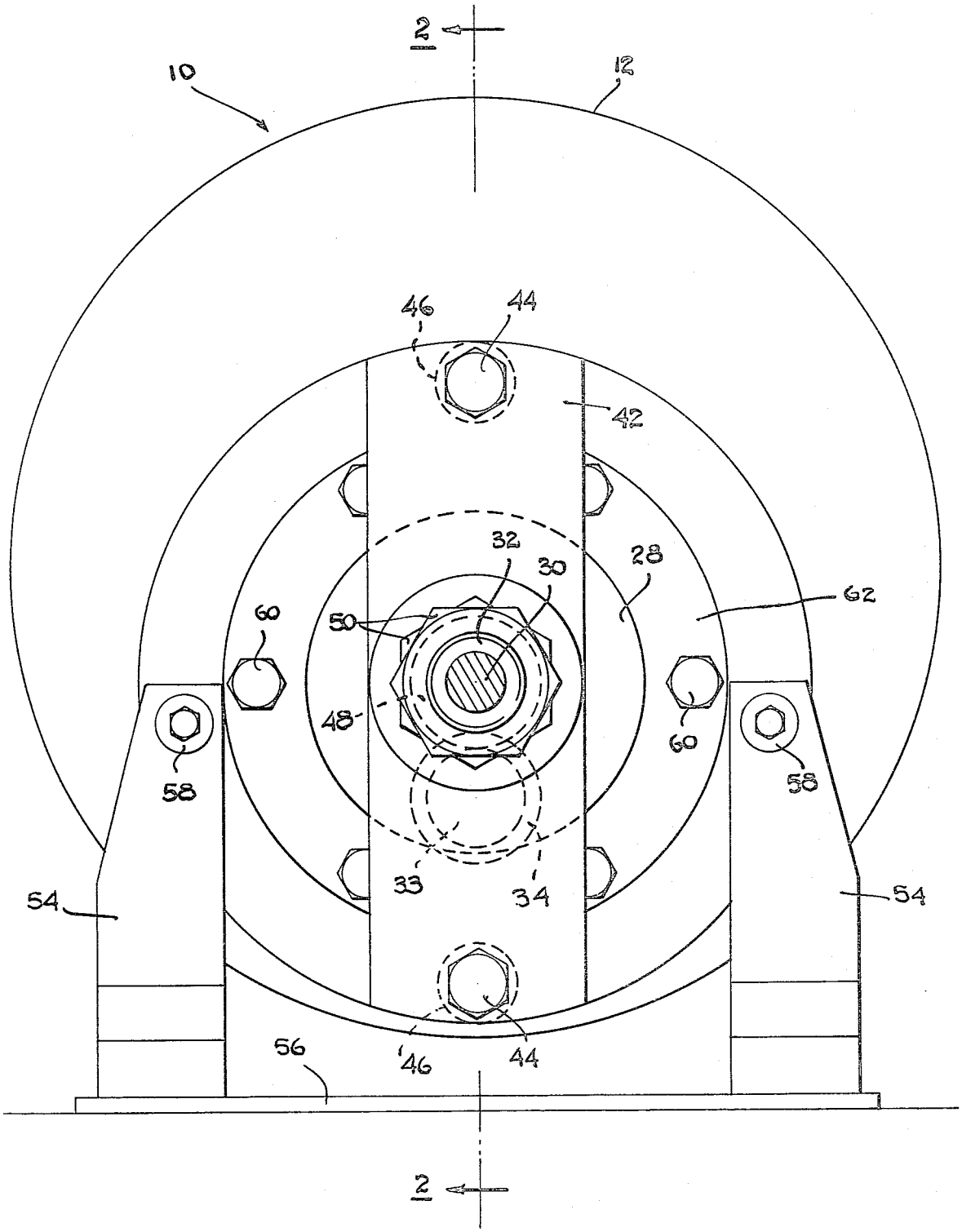
FIG. 1 comprises a rear view, partially broken away, of an epicyclic gear system in accordance with the invention.
Figure 2:
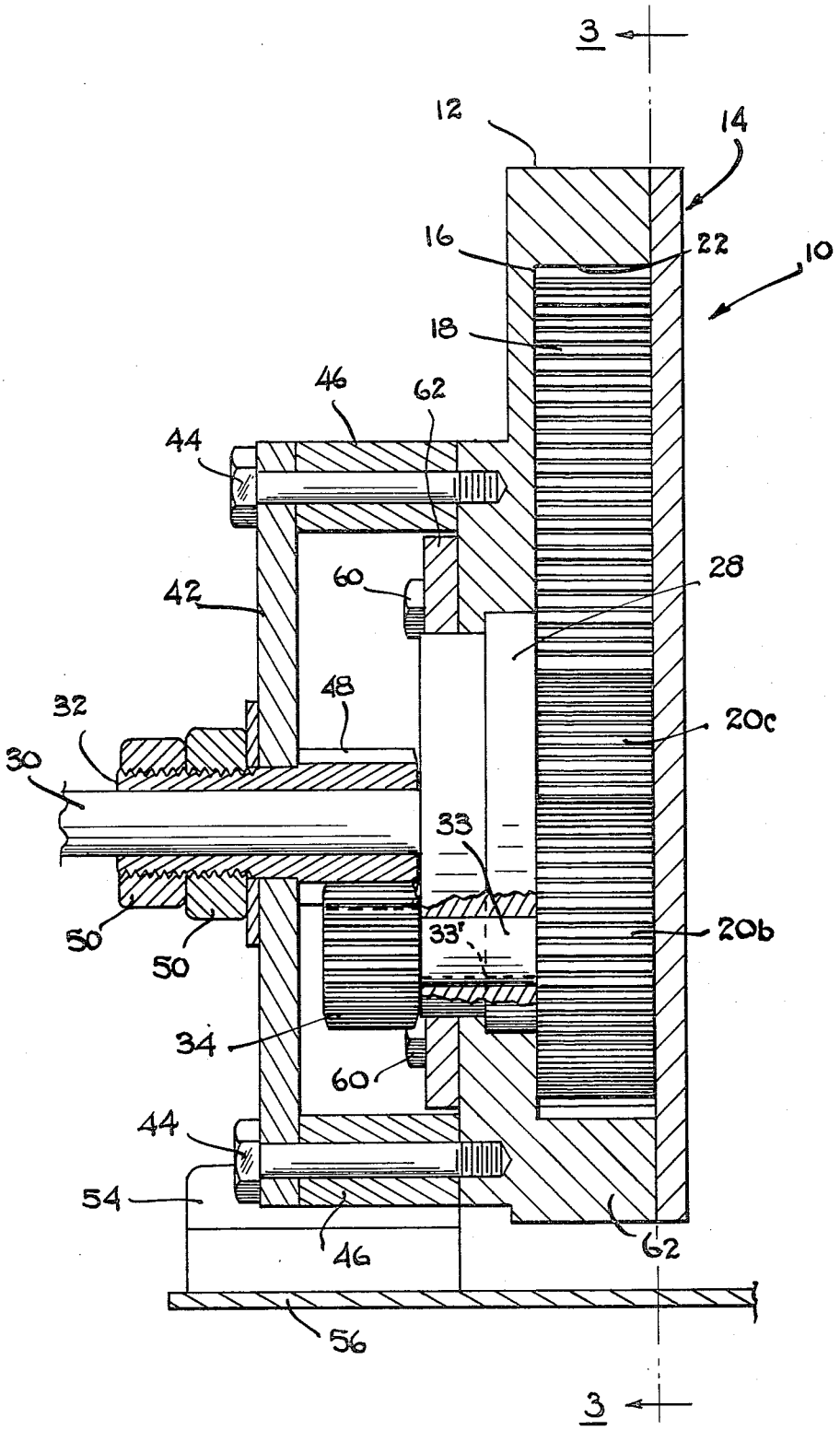
FIG. 2 comprises a sectional view, taken through the line 2—2, of the epicyclic gear system of FIG. 1.

As depicted in FIGS. 1–4, inclusive, an epicyclic gear system 10 capable of use as a pump, motor, engine, or drive for a pump or other machine includes a housing 12. The housing is sealed to the ambient and is in the form of a disc, having a forward wall 14 and an inner rear wall 16. A ring gear 18, which is circular in shape, is disposed peripherally within the housing 12 and is sealed against the forward wall 14 and the rear wall 16.

A plurality of first planetary gears **20*a*, 20*b*, 20*c* are disposed within a chamber 22 defined by the housing 12. Gears 20*a*, 20*c* are peripheral gears with respect to gear 20*b*, which is a primary planetary gear, and engage the ring gear 18. The gears 20 thus form a movable partition of the chamber 22 dividing the latter into two separate, sealed-off variable volume compartments 24, 26, the gears being sealably disposed in conjunction with the forward wall 14 and the rear wall 16**.

A rotor or rotary drive member 28 is positioned in the rear wall 16. A drive shaft 30 is disposed at its forward end within a bore 32 and is connected to rotor 28. The primary planetary gear **20*b* is eccentrically mounted with respect to rotor 28, i.e. other than coaxially with the rotor. Gear 20*b* is also mounted upon and attached to a shaft 33 by conventional means, such as a key 33'. Rearwardly, the shaft 33 is attached to a second planetary gear 34**. The invention is capable of use as a high displacement pump, motor, or engine, or as a drive for pumps or other machine.

A pair of fluid apertures 36, 38 are defined by housing 12 at the periphery thereof and communicating with the chamber 22. Apertures 36, 38 function as inlets and outlets in conjunction with function of the system as a pump or a motor, as is described in further detail below.

The rotor 28 is eccentrically displaced with respect to the central axis of the ring gear 18, and the primary planetary gear **20*b* is also eccentrically located vis a vis the center of the rotor. The eccentric displacements are equal, resulting in the situation in which in each cycle a "dead center" position will be reached in which the centers of the gears 18, 20*b*** are along a substantially straight line. In existing systems, jamming occurred in this configuration of the system and is obviated, as fully explained hereinbelow, in accordance with the present invention.

As stated, drive shaft 30 is attached to rotor 28. Shaft 30 is supported by a sleeve 32 mounted in a bar 42 attached to the rear of housing 14 by a pair of screws 44 mounted in posts 46. A sungear 48 is mounted upon sleeve 32. Gear 48 is disposed centrally and symmetrically with respect to rotor 28. Nuts 50 are mounted along the axis of the input drive shaft 30 and together with washers 52 secure the bar 42 in place.

Support brackets 54 are attached to a base 56 and to the rear of housing 12 to support the latter upon the base plate. Support brackets 54 are fastened to the rear of the housing by screws 58. Bolts 60 fasten a rear section 62 to housing 14. The drive shaft may be attached to a source of power or to a workpiece, depending on whether the device functions as a pump or as a motor.

In particular applications of the invention, other types of support and peripheral structures may be employed without departing from the invention.

Operation of the system will be depicted and described in terms of function of the system as a pump. Function as a motor is the reverse of that as a pump and will be obvious to one skilled in the art as will be function as an engine and as a drive for a pump or other machine. In its function as a pump, the working fluid is drawn into the chamber 22 through port 24 when the system is at the position depicted in FIG. 4. The input shaft 30 is then rotated clockwise. This rotation of the shaft 30 causes rotation in the same sense of rotor 28. The latter rotation produces rotatory motion of the second planetary gear 34 around the sungear 48. Since the gears **20*b*, 34 are fixed to the same shaft 33, they have the same rotational motion. The positive rotation imparted to the primary planetary gear 20*b* prevents the jamming in the dead center position experienced by existing systems. The pitch diameter of the sungear 48 and planetary gear 34 must be the same as that of the respective centrodes generated by the motion of the primary planet 20*b***.

Figure 3:
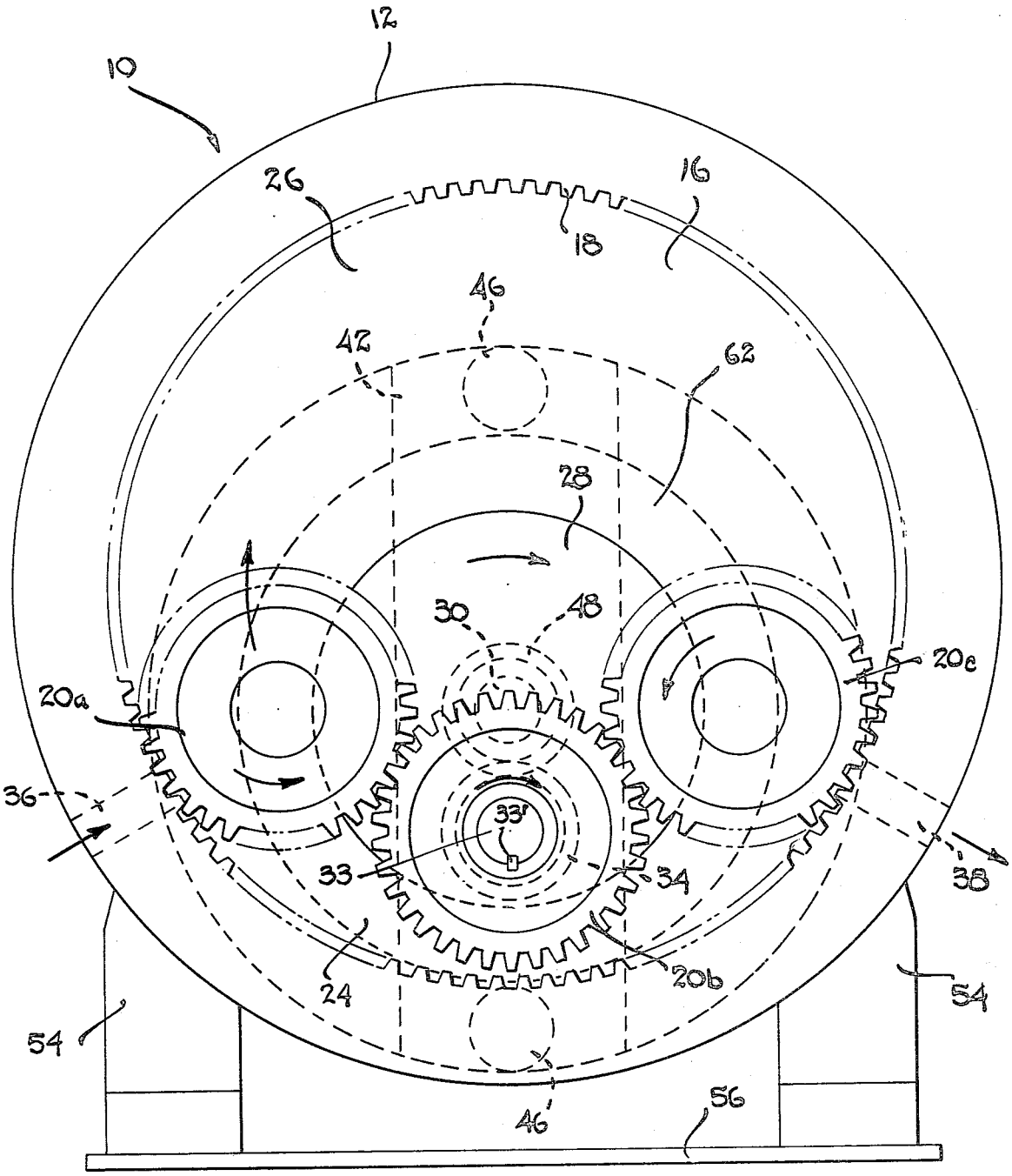
FIG. 3 comprises a sectional view, taken through the line 3—3, of the system depicted in FIG. 2.
Figure 4:
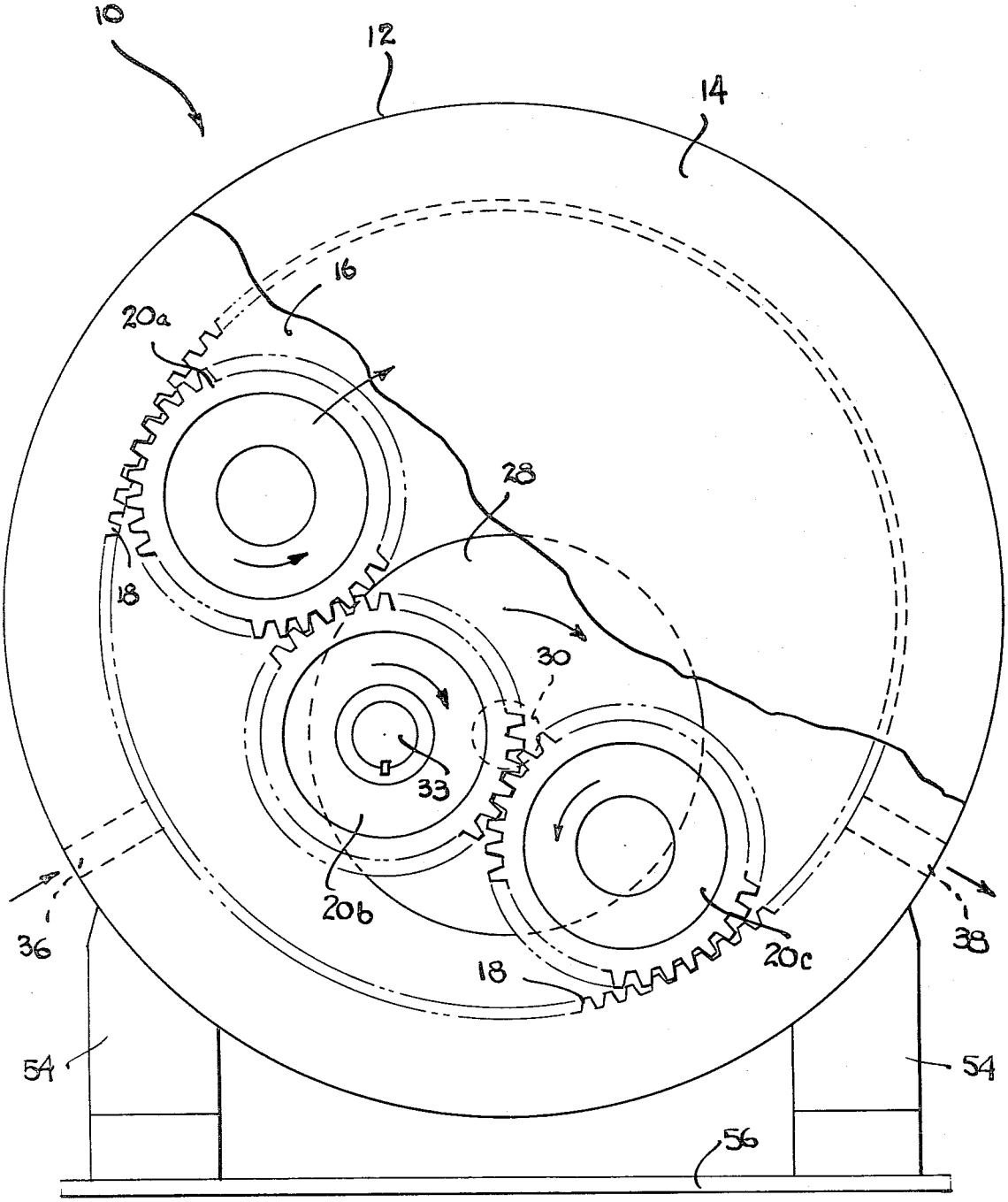
FIG. 4 comprises a sectional view as in FIG. 3 with the gears rotated to a different position.

Upon clockwise rotation of the shaft 30, the volume at the input side of the pump expands as additional fluid is drawn into the input side. As the gear system continues its motion, the expansion of the input side continues, with a corresponding decrease of volume on the output side which results in an outward pumping action through outlet 38 and a concurrent intake of fluid into the original input compartment 24. Upon further rotation, the motion of the gears results in a corresponding decrease of the volume in the input compartment and increase in the output compartment so that the fluid taken in from the inlet is fully exhausted through the outlet, when the configuration of FIG. 3 is reached.

Action of the system as a motor is the reverse of that described above for the pump function, as will be apparent to one skilled in the art, as will be operation of the system as an engine or drive for pumps or other machines. The epicyclic gear system depicted and described thus includes all of the known advantages of existing epicyclic gear systems, together with the major advantage of operability in a smooth and consistent fashion without the risk of jamming in any configuration of the gears and particularly in the dead center configuration.

Though a particular embodiment of the invention has been depicted and described above, the invention is defined solely by the appended claims interpreted in light of the specification.

What is claimed is:

1. An epicyclic gear system capable of use as a pump or a motor comprising:

a housing;

a ring gear within said housing;

a plurality of epicyclic gears disposed within said housing and sealed therein to form a first variable volume compartment and a second variable volume compartment within said housing; and drive means attached to at least one of said epicyclic gears, said drive means including means for displacing said at least one epicyclic gear and means for imparting rotary motion to said at least one epicyclic gear about its own axis, said latter means including rotating means and second gear means, the latter comprising a sungear and a planetary gear in engagement with one another, said sungear being fixed with respect to said housing, said planetary gear rolling on said sungear in response to rotation of said rotating means and being connected to said at least one epicyclic gear, the latter being in engagement with at least two of said epicyclic gears.

2. The invention as set forth in claim 1 wherein said rotary means is axially connected to drive shaft means and wherein the axis of said sungear is coincident with said drive shaft means.

3. An epicyclic gear system comprising;

an outer ring gear;

at least two peripheral planetary gears engaged with said outer gear;

a primary planetary gear engaged with said peripheral gear; and drive means connected to said primary planetary gear, said drive means including rotor means, said primary planetary gear being mounted eccentrically upon said rotor means, said drive means further including a sungear and a planetary gear, other than that aforementioned, said last mentioned planetary gear being movably engaged with said sungear, said sungear being substantially coaxial with said rotor means and said planetary gear in said drive means being connected to said primary planetary gear to impart rotary motion thereto.

4. The invention as set forth in claim 3 further including drive shaft means substantially coaxial with said sungear.

5. The invention as set forth in claim 3 wherein said outer gear, peripheral planetary gears, and primary planetary gear are positioned in a sealed chamber, said peripheral gears and primary planetary gear defining at least two variable volume compartments in said chamber sealed from one another.

6. The invention as set forth in claim 5 further including at least two fluid flow passages connecting the interior of said chamber to the ambient.

* * * * *